US009013111B2

(12) United States Patent
Lin et al.

(10) Patent No.: US 9,013,111 B2
(45) Date of Patent: Apr. 21, 2015

(54) FULL-BRIDGE ELECTRONIC BALLAST HAVING SIMPLIFIED CONTINUOUS-CONDUCTION-MODE CHARGE PUMP PFC CIRCUIT

(75) Inventors: Ray-Lee Lin, Tainan (TW); Jung-Wei Chang, Tainan (TW)

(73) Assignee: National Cheng Kung University (TW)

( * ) Notice: Subject to any disclaimer, the term of this patent is extended or adjusted under 35 U.S.C. 154(b) by 278 days.

(21) Appl. No.: 13/271,714

(22) Filed: Oct. 12, 2011

(65) Prior Publication Data

US 2012/0086350 A1 Apr. 12, 2012

(30) Foreign Application Priority Data

| | | |
|---|---|---|
| Oct. 12, 2010 | (TW) | 99134807 A |
| Oct. 12, 2010 | (TW) | 99134808 A |
| Oct. 12, 2010 | (TW) | 99134809 A |
| Oct. 12, 2010 | (TW) | 99134810 A |
| Oct. 12, 2010 | (TW) | 99134813 A |
| Oct. 12, 2010 | (TW) | 99134816 A |

(51) Int. Cl.

| | |
|---|---|
| ***H05B 37/00*** | (2006.01) |
| ***H05B 41/282*** | (2006.01) |
| ***H05B 41/28*** | (2006.01) |

(52) U.S. Cl.

CPC ..... *H05B 41/2828* (2013.01); *H05B 41/28* (2013.01)

(58) Field of Classification Search

CPC . H05B 37/023; H05B 33/0815; H02M 3/335; H02M 1/32; H02M 2001/4291; H02M 3/158; H02M 7/217

USPC ..... 315/200 R, 201–208

See application file for complete search history.

(56) References Cited

U.S. PATENT DOCUMENTS

| | | | | |
|---|---|---|---|---|
| 4,996,462 | A * | 2/1991 | Krummel | 315/209 R |
| 2009/0290384 | A1* | 11/2009 | Jungreis | 363/17 |
| 2011/0149622 | A1* | 6/2011 | Lin | 363/124 |

OTHER PUBLICATIONS

Hsu-Ming Shih (master student), approved by Ray-Lee Lin (professor), et al., Piezoelectric Transformer-Based Continuous-Conduction-Mode Charge-Pump Power-Factor-Correction Electronic Ballasts, (pp. 1-73), Master of Science in Electrical Engineering National Cheng Kung University, Tainan, Taiwan, R.O.C. (Jul. 27, 2006).*

Ray-Lee Lin et al., Piezoelectric transformer based continous-conduction-mode voltage source charge-pump power factor correction electronic ballast, proceedings of EPAC 2006, Edinburgh, Scotland.*

(Continued)

*Primary Examiner* — Douglas W Owens
*Assistant Examiner* — Monica C King
(74) *Attorney, Agent, or Firm* — Volpe and Koenig, P.C.

(57) ABSTRACT

The configurations of an electronic ballast are provided in the present invention. The proposed electronic ballast includes a filter circuit having a first and a second output terminals, a rectifier circuit having a first input terminal, a second input terminal coupled to the second output terminal of the filter circuit, and a first output terminal, and a continuous-conduction-mode charge pump PFC circuit including a first inductor having a first terminal coupled to the first input terminal and a second terminal coupled to the first output terminal of the filter circuit, a second inductor having a first terminal and a first capacitor having a first terminal coupled to the first terminal of the first inductor and a second terminal coupled to the first terminal of the second inductor.

10 Claims, 11 Drawing Sheets

(56) References Cited

OTHER PUBLICATIONS

Ray-Lee Lin et al., AC-Side CCM CS-CP-PFC Electronic Ballast, IEEE transactions on power electronics, vol. 22, No. 3, IEEE, May 2007.*

Ray-Lee Lin (PhD student), Piezoelectric Transformer Characterization and Application of Electronic Ballast, Electrical Engineering of Virginia Tech, Blacksburg, Virginia, USA (Nov. 26, 2001).*

* cited by examiner

FULL-BRIDGE ELECTRONIC BALLAST HAVING SIMPLIFIED CONTINUOUS-CONDUCTION-MODE CHARGE PUMP PFC CIRCUIT

FIELD OF THE INVENTION

The application claims the benefit of Taiwan Patent Application Nos. 099134807-099134810, 099134813 and 099134816, filed on Oct. 12, 2010, in the Taiwan Intellectual Property Office, the disclosures of which are incorporated herein in their entirety by reference.

The present invention relates to a full-bridge electronic ballast having a continuous-conduction-mode charge pump power factor correction (PFC) circuit. More particularly, it relates to a full-bridge electronic ballast having a simplified voltage-source (or current-source) continuous-conduction-mode charge pump PFC circuit.

BACKGROUND OF THE INVENTION

Following the progress of the illumination techniques, the electromagnetic ballasts are gradually replaced by the electronic ballasts to be applied to the illumination market. Comparing with the electromagnetic ballasts, the electronic ballasts have the advantages of small size, light weight, less flicker and longer lifetime and possess the competition power while they are applied to the illumination market so that the electronic ballasts have an extremely large development potential. In order to meet the IEC 61000-3-2 Class C regulation for the input current, the electronic ballasts having the PFC functions have been employed in the illumination apparatuses generally. Currently, the two-stage electronic ballasts having the PFC functions (as shown in FIG. 1) are the mainstream, and the two-stage electronic ballast comprises an AC input power source (supplying an AC input voltage Vin), a filter circuit (comprising an inductor $L_{EMI}$ and a capacitor $C_{EMI}$), a rectifier circuit (comprising four diodes $D_{br1}$-$D_{br4}$), a PFC stage (comprising an inductor $L_{pfc}$, a diode $D_y$ and a switch $S_{pfc}$) and a full-bridge inverter (comprising an inductor $L_s$, two capacitors $C_B$ and $C_p$, four switches S1-S4 and a lamp) with the drawbacks of:

(1) requiring more elements, thus to have the relatively higher costs of the electronic circuit, (2) requiring control ICs in both the PFC circuit and the power stage, thus to have the relatively complex circuit.

To solve the above-mentioned drawbacks, a half-bridge electronic ballast having a discontinuous-conduction-mode (DCM) charge-pump (CP) PFC circuit (as shown in FIG. 2) has been developed. Except for the AC input power source, the filter circuit and the rectifier circuit as shown in FIG. 1, the half-bridge electronic ballast having the DCM CP PFC circuit comprises a PFC stage (comprising a capacitor $C_{in}$ and a diode $D_y$), a half-bridge inverter (comprising an inductor $L_s$, two capacitors $C_B$ and $C_p$, two switches S1-S2 and a lamp) and an output capacitor $C_{dc}$. However, the half-bridge electronic ballast having the DCM CP PFC circuit still has the following drawbacks:

(1) the circuit operating in DCM, such that the input current has a relatively larger di/dt, and the EMI is relatively more serious;

(2) the circuit having a relatively larger peak current, such that the circuit elements having a relatively larger withstand current must be used.

Due to that the half-bridge structure is not applicable in many medium and high power illumination applications, the present invention intends to combine the CCM CP PFC technique (see FIGS. 3 and 4) with the full-bridge electronic ballast. As shown in FIG. 3, the equivalent circuit of the CCM voltage-source CP PFC circuit has a rectified DC voltage source (supplying a rectified voltage $|V_{in}|$ and a current $I_{in}$), two diodes $D_x$ and $D_y$, an inductor $L_{pfc}$, a capacitor $C_{in}$, a voltage source (supplying a voltage $V_a$), a load and an output capacitor $C_{dc}$, and a cross voltage of the output capacitor is an output voltage $V_{bus}$. As shown in FIG. 4, the equivalent circuit of the CCM current-source CP PFC circuit differs from FIG. 3 in that there is one diode $D_x$ less, the rectified DC voltage source supplies a current $I_{pfc}$, the capacitor $C_{in}$ has a cross voltage $V_{cin}$ and is electrically connected to the diode $D_y$, the voltage source $V_a$ is replaced by a current-source (supplying a current $I_s$), and the output capacitor $C_{dc}$ is replaced by an output voltage source (supplying a DC output voltage $V_{bus}$). As a result, not only the circuit structure and the elements of the driving circuit can be simplified, but also the volumes of the PFC inductor and the input filter circuit can be reduced via the CP PFC circuit so as to decrease the circuit costs and to shrink the volume of the circuit. Due to that the circuit operates in the CCM, thus to have a relatively lower input current harmonic distortion, the relatively higher input current power factor, the relatively lower diode conduction losses and switching losses, so as to raise the overall circuit efficiency.

Keeping the drawbacks of the prior arts in mind, and employing experiments and research full-heartily and persistently, the applicant finally conceived a full-bridge electronic ballast having a simplified continuous-conduction-mode charge pump PFC circuit.

SUMMARY OF THE INVENTION

It is therefore an object of the present invention to provide a full-bridge electronic ballast having a simplified continuous-conduction-mode charge pump PFC circuit with the following advantages due to that the CP PFC technique is utilized: decreasing the required number of elements in the circuit so as to reducing the circuit costs, having low input current harmonic distortion and high power factor, decreasing the volumes of the elements such as PFC inductor and EMI filter, and decreasing the switching losses of a switch and the conduction losses of a diode.

According to the first aspect of the present invention, an electronic ballast comprises a filter circuit having a first and a second output terminals and receiving an AC input voltage, a rectifier circuit having a first input terminal, a second input terminal coupled to the second output terminal of the filter circuit, and a first output terminal, a continuous-conduction-mode charge pump PFC circuit comprising a first inductor having a first terminal coupled to the first input terminal of the rectifier circuit, and a second terminal coupled to the first output terminal of the filter circuit, a first diode having an anode and a cathode coupled to the first output terminal of the rectifier circuit, a second inductor having a first terminal, a first capacitor having a first terminal coupled to the first terminal of the first inductor and a second terminal coupled to the anode of the first diode and the first terminal of the second inductor, and a second diode having a cathode coupled to the first terminal of the second inductor, and a full-bridge inverter coupled to the continuous-conduction-mode charge pump PFC circuit and generating an AC output voltage.

According to the second aspect of the present invention, an electronic ballast comprises a rectifier circuit having a first input terminal and a second input terminal, a continuous-conduction-mode charge pump PFC circuit comprising a first inductor having a first terminal coupled to the first input terminal of the rectifier circuit, and a second terminal, a second inductor having a first terminal, and a first capacitor having a first terminal coupled to the first terminal of the first inductor and a second terminal coupled to the first terminal of the second inductor, and a full-bridge inverter coupled to the continuous-conduction-mode charge pump PFC circuit and generating an AC output voltage.

According to the third aspect of the present invention, an electronic ballast comprises a continuous-conduction-mode charge pump PFC circuit, and a full-bridge inverter coupled to the continuous-conduction-mode charge pump PFC circuit and generating an AC output voltage.

The present invention may best be understood through the following descriptions with reference to the accompanying drawings, in which:

BRIEF DESCRIPTION OF THE DRAWINGS

FIG. 12(*b*) is a simulation waveform diagram of the input voltage $V_{in}$ and the input current $I_{in}$ of a full-bridge electronic ballast having a simplified CCM voltage-source CP PFC circuit according to the eighth preferred embodiment of the present invention;

DETAILED DESCRIPTION OF THE PREFERRED EMBODIMENT

Figure 3:
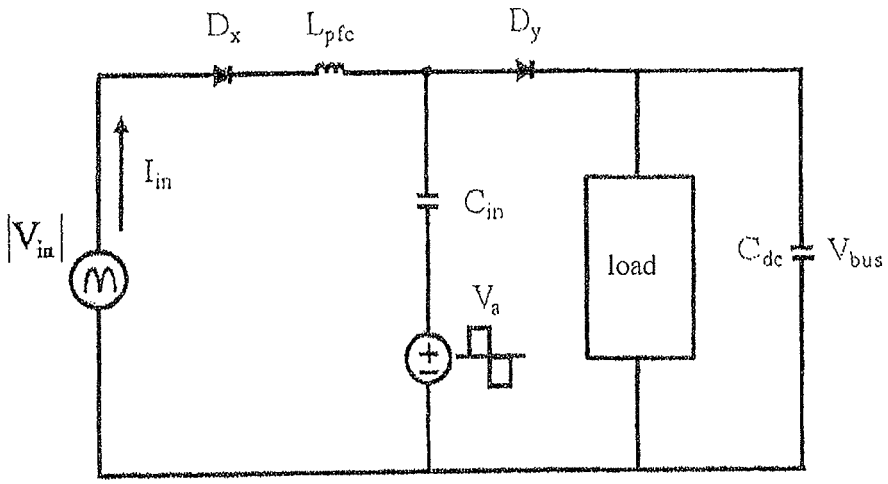
Fig. 3(Prior Art)
FIG. 3 is a circuit diagram of an equivalent circuit of a CCM voltage-source CP PFC circuit in the prior art.
Figure 4:
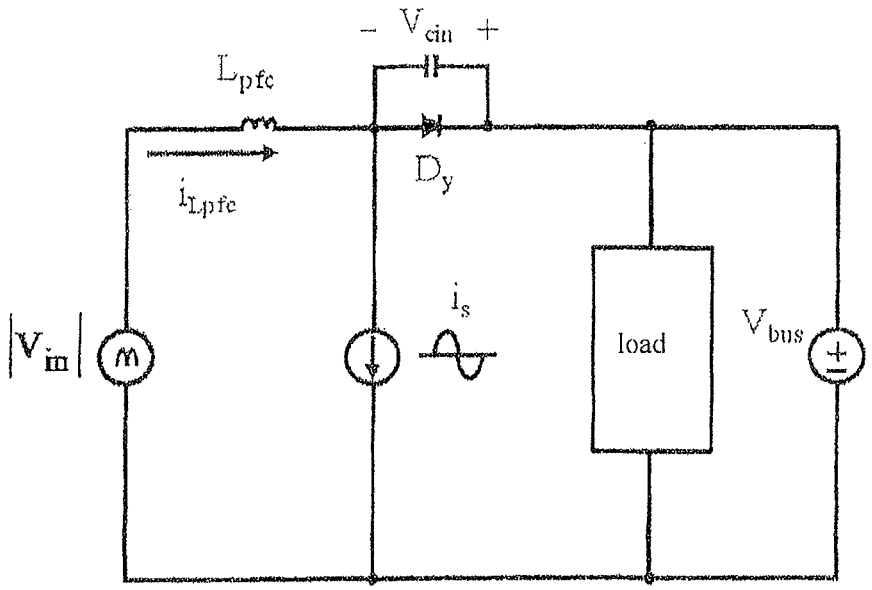
Fig. 4(Prior Art)
FIG. 4 is a circuit diagram of an equivalent circuit of a CCM current-source CP PFC circuit in the prior art.

The present invention provides a CCM CP PFC circuit comprising the PFC inductor $L_{pfc}$, the CP capacitor $C_{in}$, the equivalent diode $D_y$ etc, which can be divided into the voltage-source type and the current-source type according to different circuit connection modes as shown in the aforementioned FIGS. 3 and 4, wherein the voltage-source type mainly connects a high frequency voltage-source in series to be a reference signal source, and the current-source type connects a high frequency current-source in parallel to be a reference signal source, both of which could achieve the effect of power factor correction.

Figure 1:
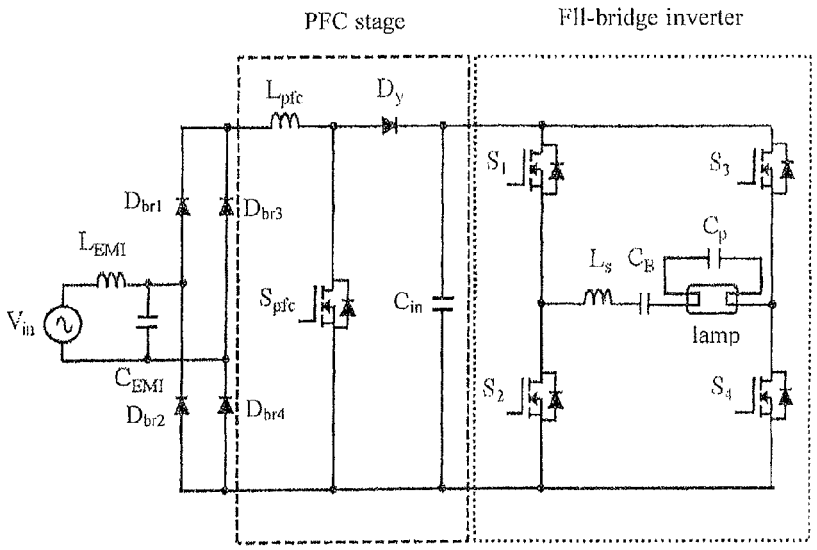
Fig. 1(Prior Art)
FIG. 1 is a circuit diagram of a conventional two-stage electronic ballast in the prior art.
Figure 2:
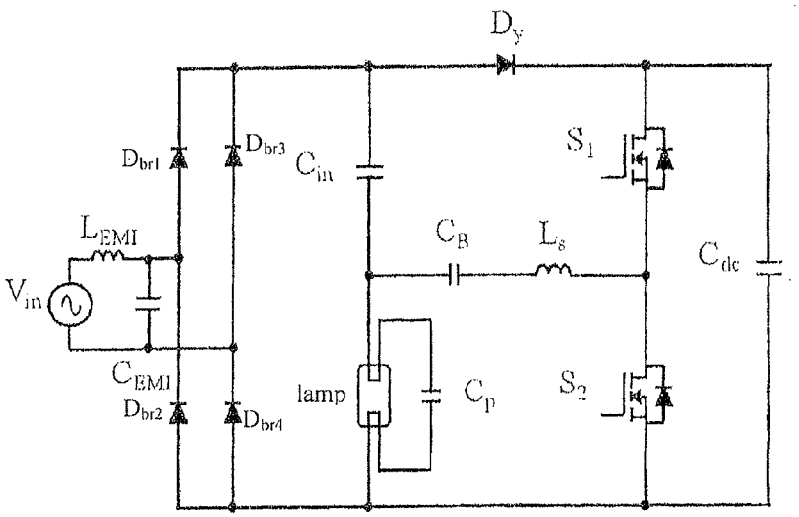
Fig. 2(Prior Art)
FIG. 2 is a circuit diagram of a half-bridge electronic ballast having a DCM CP PFC circuit in the prior art.
Figure 5:
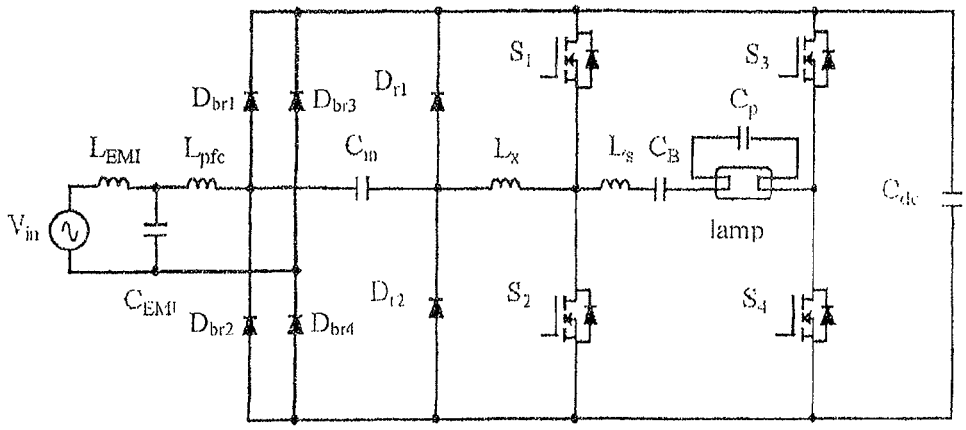
FIGS. 5-12(*a*) are respectively a circuit diagram of a full-bridge electronic ballast having a simplified CCM voltage-source CP PFC circuit according to the first to the eighth preferred embodiments of the present invention.

FIG. 5 is a circuit diagram of a full-bridge electronic ballast having a simplified continuous-conduction-mode charge pump PFC circuit according to the first preferred embodiment of the present invention. Except for the AC input power source, the filter circuit, the rectifier circuit and the full-bridge inverter as shown in FIG. 1 and the above-mentioned output capacitor $C_{dc}$ as shown in FIG. 2, FIG. 5 differs from FIG. 1 in that the PFC stage in FIG. 1 is replaced by a simplified AC-side CCM CP PFC circuit, and the simplified AC-side CCM CP PFC circuit comprises a set of the CP PFC circuit: the inductor $L_{pfc}$/the rectifier diode $D_{br1}$/the capacitor $C_{in}$/the diodes $D_{r1}$ and $D_{r2}$/the inductor $L_x$. In the aforementioned set of CP PFC circuit, the rectifier diode $D_{br1}$ in the rectifier circuit is used to replace the originally used diode $D_y$ (not shown), and the circuit is simplified since there is one diode less. In the electronic ballast as shown in FIG. 5, the first capacitor $C_{in}$ is directly connected to an end of the inductor $L_{pfc}$.

The preferred embodiments of the present invention, e.g., the full-bridge electronic ballast as shown in FIG. 5, utilize the aforementioned CP PFC technique to combine with the full-bridge electronic ballast to improve the power factor of which so as to obtain a lower harmonic distortion.

Figure 6:
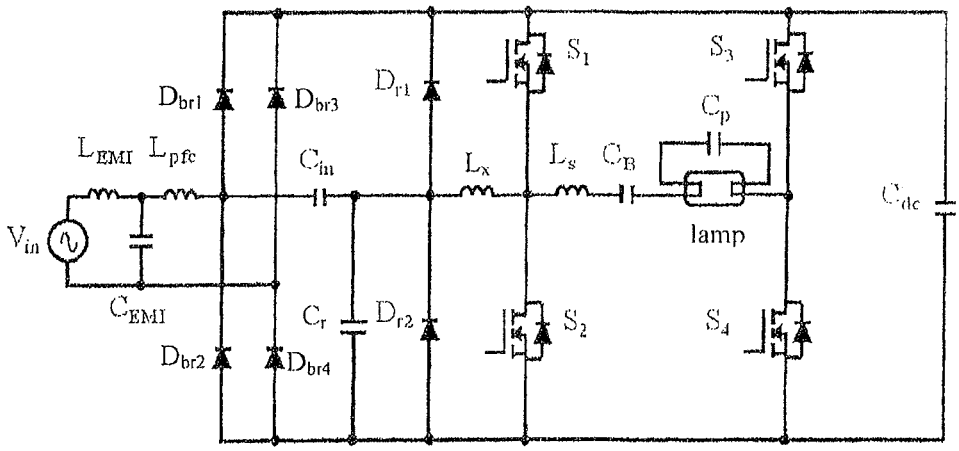

FIG. 6 is a circuit diagram of a full-bridge electronic ballast having a simplified continuous-conduction-mode charge pump PFC circuit according to the second preferred embodiment of the present invention. The electronic ballast as shown in FIG. 6 differs from the electronic ballast as shown in FIG. 5 mainly in that the electronic ballast in FIG. 6 further comprises a resonant tank comprising a resonant capacitor $C_r$: $C_r/L_x$.

Figure 7:
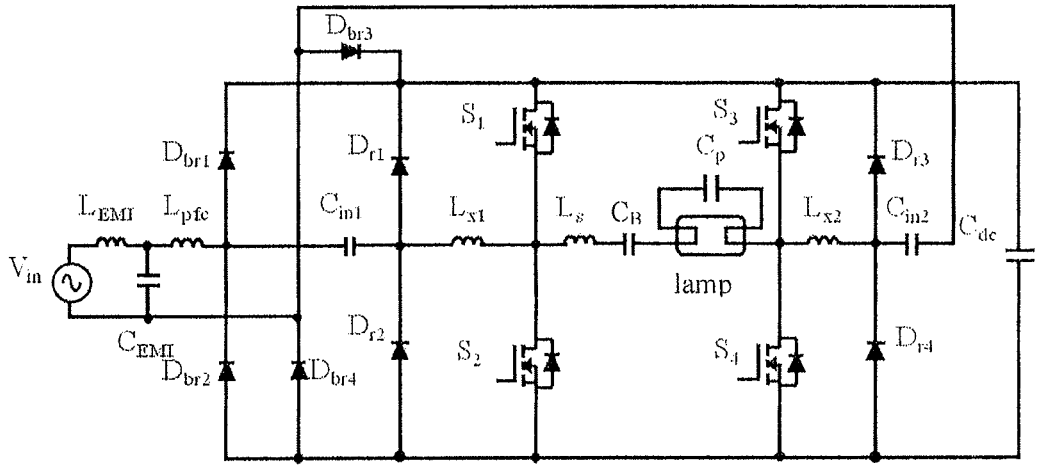

FIG. 7 is a circuit diagram of a full-bridge electronic ballast having a simplified continuous-conduction-mode charge pump PFC circuit according to the third preferred embodiment of the present invention. The electronic ballast as shown in FIG. 7 differs from the electronic ballast as shown in FIG. 6 mainly in that the electronic ballast in FIG. 7 comprises two sets of CP PFC circuits: 1. the Inductor $L_{pfc}$/the rectifier diode $D_{br1}$/the capacitor $C_{in1}$/the diode $D_{r1}$/the inductor $L_{x1}$ and 2. The inductor $L_{pfc}$/the rectifier diode $D_{br3}$/the capacitor $C_{in2}$/the clamping diode $D_{r2}$/the inductor $L_{x2}$. In the above-mentioned two sets of CP PFC circuits, the rectifier diodes $D_{br1}$ and $D_{br3}$ are used to replace the two originally used diodes $D_{y1}$ and $D_{y2}$ (not shown), and the circuit is simplified since there are two diodes less.

Figure 8:
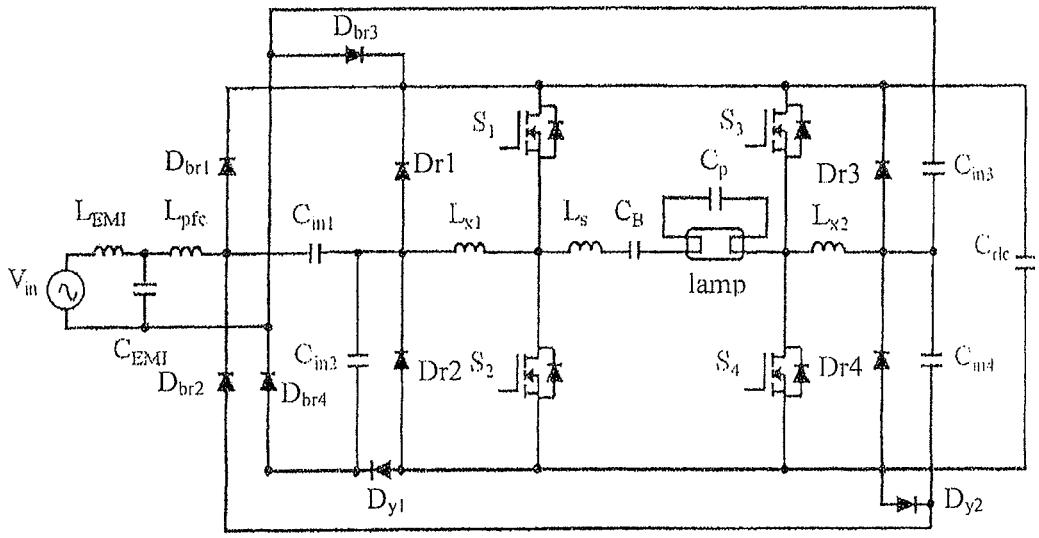

FIG. 8 is a circuit diagram of a full-bridge electronic ballast having a simplified continuous-conduction-mode charge pump PFC circuit according to the fourth preferred embodiment of the present invention.

The electronic ballast as shown in FIG. 8 differs from the electronic ballast as shown in FIG. 7 in that the connection modes of the two clamping diodes $D_{r1}$ and $D_{r2}$ are different from those of FIG. 7.

Figure 9:
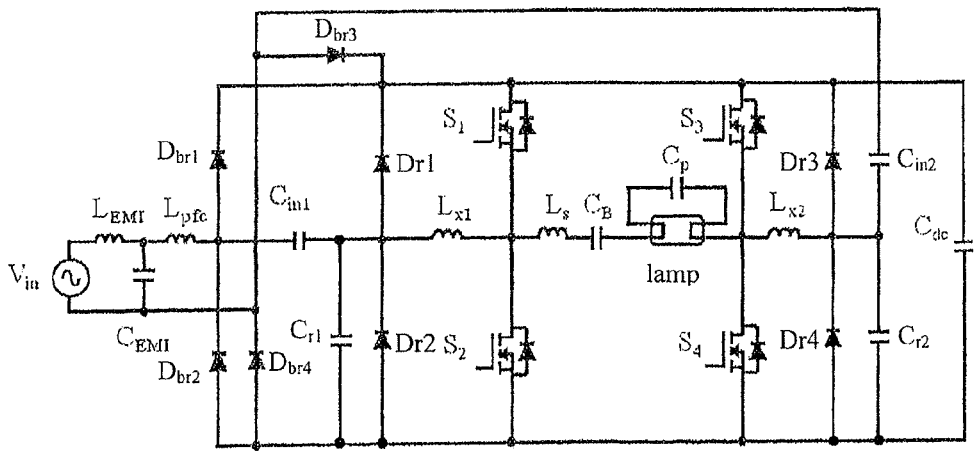

FIG. 9 is a circuit diagram of a full-bridge electronic ballast having a simplified continuous-conduction-mode charge pump PFC circuit according to the fifth preferred embodiment of the present invention. The electronic ballast as shown in FIG. 9 differs from the electronic ballasts as shown in FIGS. 7 and 8 mainly in that there are four clamping diodes $D_{r1}$-$D_{r4}$ in FIG. 9.

Figure 10:
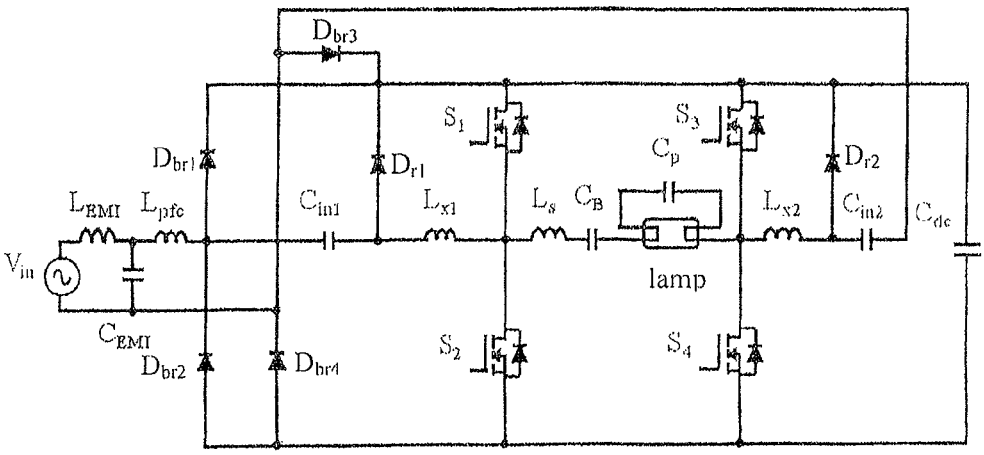

FIG. 10 is a circuit diagram of a full-bridge electronic ballast having a simplified continuous-conduction-mode charge pump PFC circuit according to the sixth preferred embodiment of the present invention. The electronic ballast as shown in FIG. 10 differs from the electronic ballast as shown in FIG. 9 mainly in that there are four sets of CP PFC circuit in FIG. 10:

1. $L_{pfc}/D_{br1}/C_{in1}/D_{r1}/L_{x1}$, 2. $L_{pfc}/D_{y1}/C_{in2}/D_{r2}/L_{x1}$, 3. $L_{pfc}/D_{br3}/C_{in3}/D_{r3}/L_{x2}$, and 4. $L_{pfc}/D_{y2}/C_{in4}/D_{r4}/L_{x2}$. p In the above-mentioned four sets of CP PFC circuits, the rectifier diodes $D_{br1}$ and $D_{br3}$ are used to replace the two originally used diodes $D_{y3}$ and $D_{y3}$ (not shown) in the two specific sets of CP PFC circuits, and the circuit is simplified since there are two diodes less.

Figure 11:
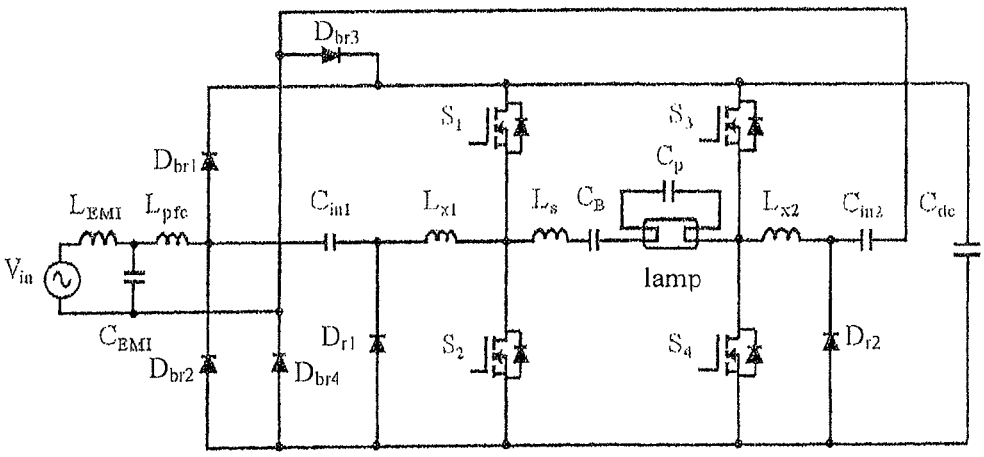

FIG. 11 is a circuit diagram of a full-bridge electronic ballast having a simplified continuous-conduction-mode charge pump PFC circuit according to the seventh preferred embodiment of the present invention. The electronic ballast as shown in FIG. 11 differs from the electronic ballast as shown in FIG. 10 mainly in that the equivalent diodes $D_{y1}$-$D_{y4}$ (not shown) in the four sets of CP PFC circuit are replaced by the rectifier diodes $D_{r1}$-$D_{r4}$.

Figure 12A:
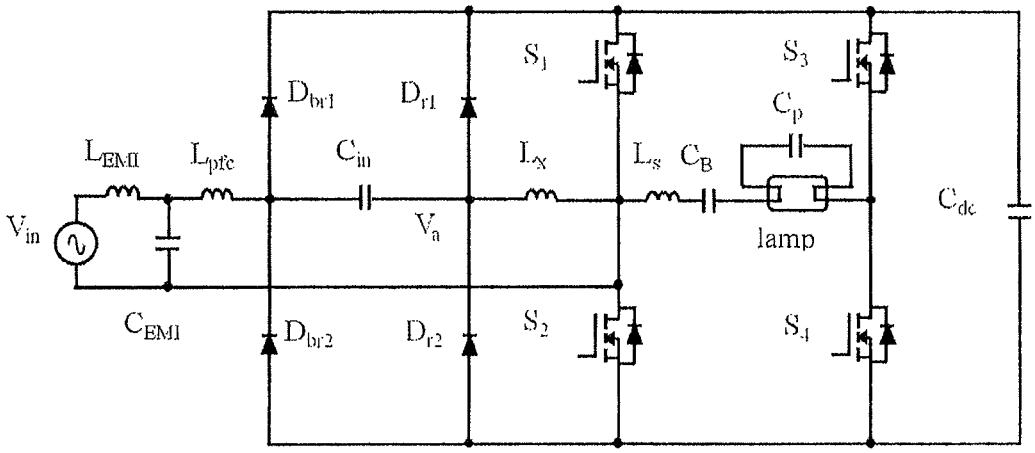
Figure 12B:
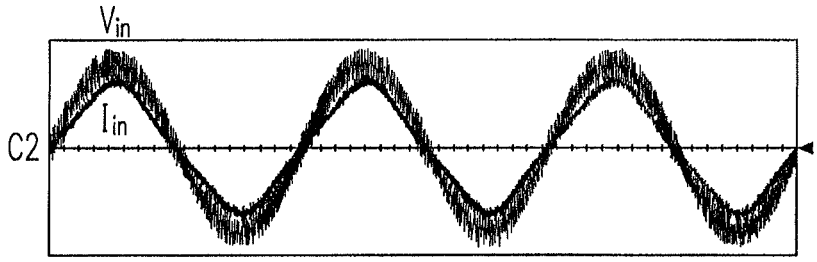

FIG. 12(*a*) is a circuit diagram of a full-bridge electronic ballast having a simplified continuous-conduction-mode charge pump PFC circuit according to the eighth preferred embodiment of the present invention. As shown in FIG. 12(*a*), the electronic ballast includes a filter circuit having a first and a second output terminals and receiving an AC input voltage, a rectifier circuit having a first input terminal, a second input terminal coupled to the second output terminal of the filter circuit, and a first output terminal, a continuous-conduction-mode charge pump PFC circuit comprising a first inductor $L_{pfc}$ having a first terminal coupled to the first input terminal of the rectifier circuit and a second terminal coupled to the first output terminal of the filter circuit, a first diode $D_{r1}$ having an anode and a cathode coupled to the first output terminal of the rectifier circuit, a second inductor $L_x$ having a first terminal, a first capacitor $C_{in}$ having a first terminal coupled to the first terminal of the first inductor $L_{pfc}$ and a second terminal coupled to the anode of the first diode $D_{r1}$ and the first terminal of the second inductor $L_x$, and a second diode $D_{r2}$ having a cathode coupled to the first terminal of the second inductor $L_x$, and a full-bridge inverter coupled to the continuous-conduction-mode charge pump PFC circuit and generating an AC output voltage.

In FIG. 12(*a*), the electronic ballast further includes a second capacitor $C_{dc}$, wherein the rectifier circuit further comprises a second output terminal, the full-bridge inverter has a first and a second input terminals, a middle point, a first and a second output terminals and a bridge arm, the bridge arm includes a first switch $S_1$ coupled to the first input terminal of the full-bridge inverter and the middle point, and having a first bypass diode, and a second switch $S_2$ coupled to the middle point and the second input terminal of the full-bridge inverter, and having a second bypass diode, the continuous-conduction-mode charge pump PFC circuit further includes a third diode $D_{br1}$ having an anode coupled to the first terminal of the first capacitor $C_{in}$ and a cathode coupled to the cathode of the first diode $D_{r1}$, the third diode $D_{br1}$ is used to replace the equivalent diode $D_y$ of the CP PFC circuit so as to simplified the circuit, the second inductor $L_x$ has a second terminal coupled to the middle point of the full-bridge inverter, the cathode of the first diode $D_{r1}$ is coupled to the first input terminal of the full-bridge inverter, the second input terminal of the full-bridge inverter is coupled to the second output terminal of the rectifier circuit, the rectifier circuit comprises the third diode $D_{br1}$, the first bypass diode of the first switch, the second bypass diode of the second switch and a fourth diode D*br*2, the second diode $D_{r2}$ further comprises an anode coupled to the second input terminal of the full-bridge inverter, and the second capacitor $C_{dc}$ is electrically connected to the first and the second output terminals of the full-bridge inverter in parallel. The second capacitor $C_{dc}$ is an output capacitor, and the continuous-conduction-mode charge pump PFC circuit is a continuous-conduction-mode voltage-source charge pump PFC circuit.

FIG. 12(*b*) is a simulation waveform diagram of the input voltage $V_{in}$ and the input current $I_{in}$ of a full-bridge electronic ballast having a simplified continuous-conduction-mode charge pump PFC circuit according to the eighth preferred embodiment of the present invention.

Please refer to FIG. 12(*a*), the electronic ballast includes a filter circuit having a first and a second output terminals and receiving an AC input voltage, a rectifier circuit having a first input terminal and a second input terminal coupled to the second output terminal of the filter circuit, a continuous-conduction-mode charge pump PFC circuit comprising a first inductor having a first terminal coupled to the first input terminal of the rectifier circuit and a second terminal coupled to the first output terminal of the filter circuit, a second inductor having a first terminal, and a first capacitor having a first terminal coupled to the first terminal of the first inductor, and a second terminal coupled to the first terminal of the second inductor, and a full-bridge inverter coupled to the continuous-conduction-mode charge pump PFC circuit and generating an AC output voltage.

Figure 13:
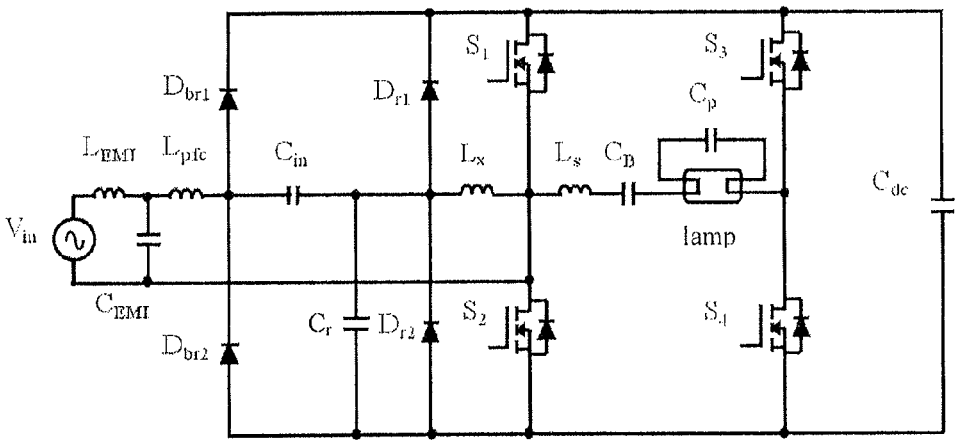
FIG. 13 is a circuit diagram of a full-bridge electronic ballast having a simplified CCM voltage-source CP PFC circuit according to the ninth preferred embodiment of the present invention.

FIG. 13 is a circuit diagram of a full-bridge electronic ballast having a simplified continuous-conduction-mode charge pump PFC circuit according to the ninth preferred embodiment of the present invention. The electronic ballast as shown in FIG. 13 differs from the electronic ballast as shown in FIG. 12(*a*) mainly in that the CCM CP PFC circuit further comprises a third capacitor $C_r$ having a first terminal coupled to the first terminal of the second inductor $L_x$ and a second terminal coupled to the anode of the second diode $D_{r2}$, and the third capacitor $C_r$ is a resonant capacitor formed a resonant tank with the second inductor $L_x$.

The unique features of the electronic ballasts respectively shown in FIGS. 12(*a*) and 13 can be generalized as the electronic ballast includes a filter circuit having a first and a second output terminals and receiving an AC input voltage, a rectifier circuit having a first input terminal and a second input terminal coupled to the second output terminal of the filter circuit, a CCM CP PFC circuit comprising a first inductor $L_{pfc}$ having a first terminal coupled to the first input terminal of the rectifier circuit and a second terminal coupled to the first output terminal of the filter circuit, a second inductor $L_x$ having a first terminal, and a first capacitor $C_{in}$ having a first terminal coupled to the first terminal of the first inductor $L_{pfc}$ and a second terminal coupled to the first terminal of the second inductor $L_x$, and a full-bridge inverter coupled to the CCM CP PFC circuit and generating an AC output voltage.

The electronic ballasts respectively shown in FIGS. 12(*a*) and 13 further comprise a first and a second diodes $D_{r1}$ and $D_{r2}$, each of which comprises an anode and a cathode, wherein the rectifier circuit further comprises a first and a second output terminals, the cathode of the first diode is coupled to the first output terminal of the rectifier circuit, the anode of the first diode $D_{r1}$ is coupled to the second terminal of the first capacitor $C_{in}$, the cathode of the second diode $D_{r2}$ is coupled to the first terminal of the second inductor $L_x$, and the anode of the second diode $D_{r2}$ is coupled to the second output terminal of the rectifier circuit.

Figure 14:
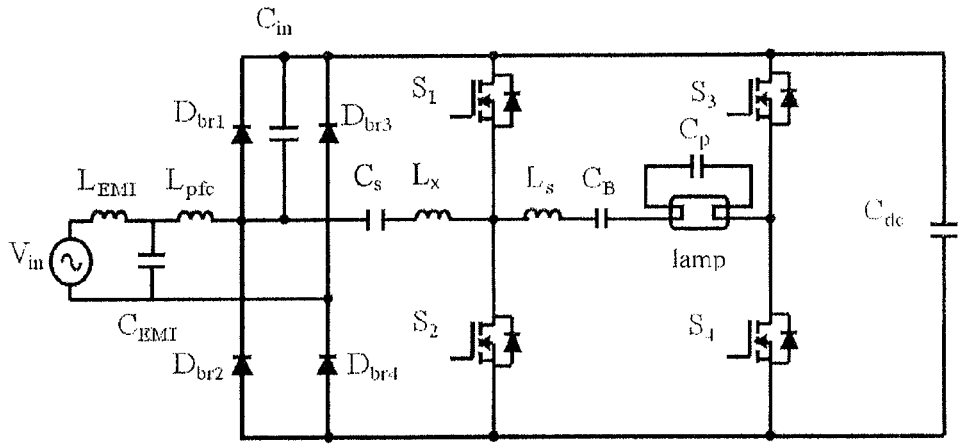
FIGS. 14-19 are respectively a circuit diagram of a full-bridge electronic ballast having a simplified CCM current-source CP PFC circuit according to the tenth to the fifteenth preferred embodiments.

FIG. 14 is a circuit diagram of a full-bridge electronic ballast having a simplified continuous-conduction-mode charge pump PFC circuit according to the tenth preferred embodiment of the present invention. As shown in FIG. 14, the electronic ballast comprises a set of CP PFC circuit, $L_{pfc}/D_{br1}/C_{in}/C_s/L_x$, wherein a diode $D_{br1}$ of a rectifier circuit (comprising rectifier diodes $D_{br1}$-$D_{br4}$) is used to replace the equivalent diode $D_y$ (not shown) of the set of CP PFC circuit so as to simplified the circuit of the ballast.

Figure 15:
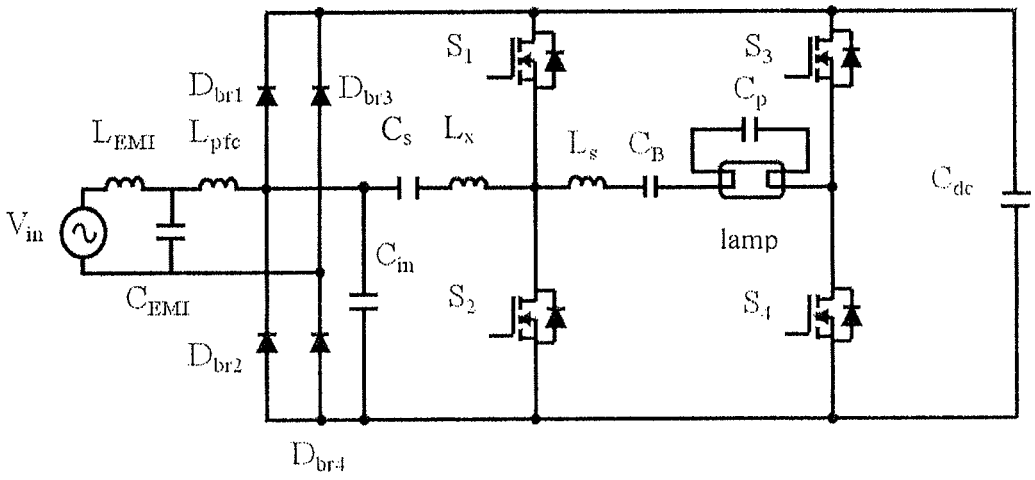

FIG. 15 is a circuit diagram of a full-bridge electronic ballast having a simplified continuous-conduction-mode charge pump PFC circuit according to the eleventh preferred embodiment of the present invention. The electronic ballast as shown in FIG. 15 differs from the electronic ballast as shown in FIG. 14 mainly in that the connection mode of the capacitor $C_{in}$ is different from that of FIG. 14.

Figure 16:
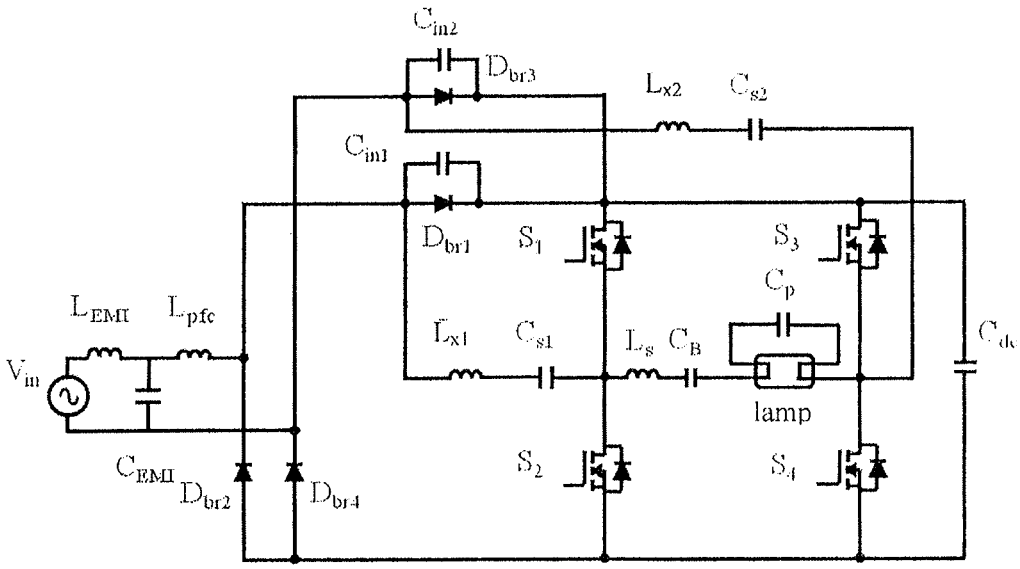

FIG. 16 is a circuit diagram of a full-bridge electronic ballast having a simplified continuous-conduction-mode charge pump PFC circuit according to the twelfth preferred embodiment of the present invention, in which there are two sets of CP PFC circuits: $L_{pfc}/D_{br1}/C_{in1}/L_{x1}/C_{s1}$ and $L_{pfc}/D_{br2}/C_{in2}/L_{x2}/C_{s2}$. Two diodes $D_{br1}$ and $D_{br3}$ of a rectifier circuit comprising rectifier diodes $D_{br1}$-$D_{br4}$ are used to replace the equivalent diodes $D_{y1}/D_{y2}$ (not shown) of the two sets of CP PFC circuits so as to simplified the circuit of the electronic ballast.

Figure 17:
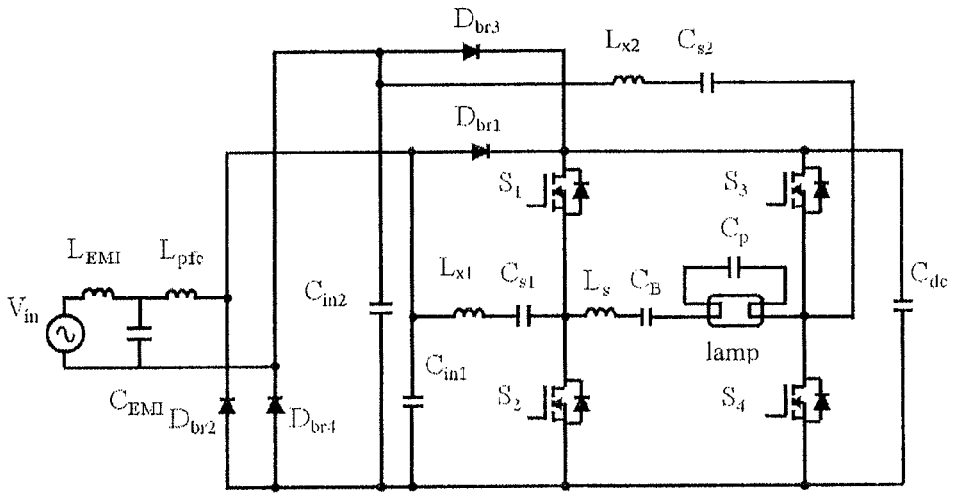

FIG. 17 is a circuit diagram of a full-bridge electronic ballast having a simplified continuous-conduction-mode charge pump PFC circuit according to the thirteen preferred embodiment of the present invention. The electronic ballast as shown in FIG. 17 differs from the electronic ballast as shown in FIG. 16 mainly in that the connection modes of the two capacitors $C_{in1}$ and $C_{in1}$ are different from those of FIG. 16.

Figure 18:
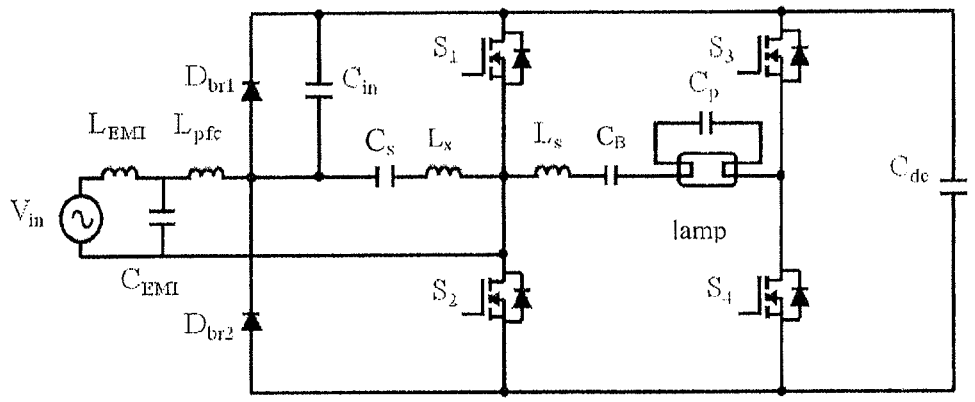

FIG. 18 is a circuit diagram of a full-bridge electronic ballast having a simplified continuous-conduction-mode charge pump PFC circuit according to the fourteenth preferred embodiment of the present invention. Referring to the electronic ballast as shown in FIG. 18, it includes a filter circuit having a first and a second output terminals and receiving an AC input voltage, a rectifier circuit having a first input terminal and a second input terminal coupled to the second output terminal of the filter circuit, a continuous-conduction-mode charge pump PFC circuit comprising a first inductor $L_{pfc}$ having a first terminal coupled to the first input terminal of the rectifier circuit and a second terminal coupled to the first output terminal of the filter circuit, a first capacitor $C_{in}$ having a first terminal, a second capacitor $C_s$ having a first terminal coupled to the first terminal of the first capacitor $C_{in}$, and a second terminal, and a second inductor $L_x$ having a first terminal coupled to the second terminal of the second capacitor $C_s$, and a full-bridge inverter coupled to the continuous-conduction-mode charge pump PFC circuit and generating an AC output voltage.

Please refer to the electronic ballast as shown in FIG. 18, wherein the rectifier circuit includes the diode $D_{br1}$, the bypass diode of the first switch $S_1$, the bypass diode of the second switch $S_2$ and the diode $D_{br2}$, the diode $D_{br1}$ is used to replace the diode $D_y$ (not shown) of the CP PFC circuit so as to simplified the circuit. The first capacitor $C_{in}$ further comprises a second terminal coupled to the first output terminal of the rectifier circuit, and the continuous-conduction-mode charge pump PFC circuit is a continuous-conduction-mode current-source charge pump PFC circuit.

Figure 19:
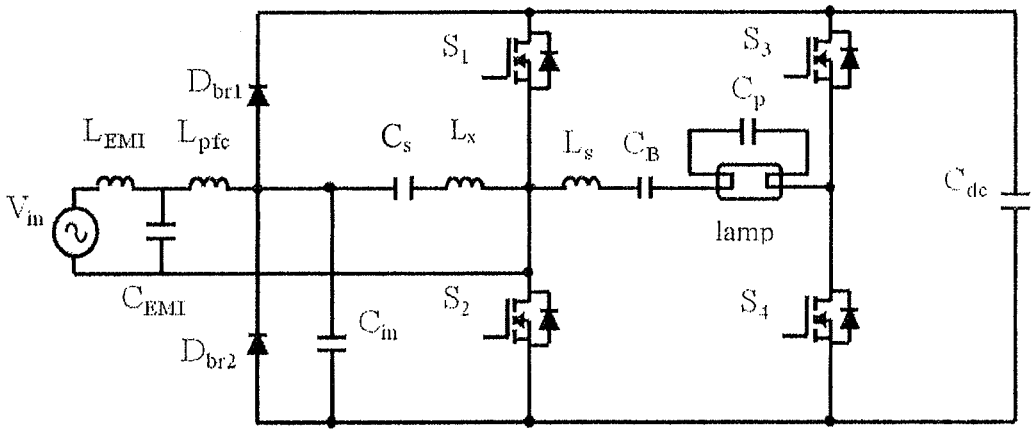

FIG. 19 is a circuit diagram of a full-bridge electronic ballast having a simplified continuous-conduction-mode charge pump PFC circuit according to the fifteenth preferred embodiment of the present invention. The electronic ballast as shown in FIG. 19 differs from the electronic ballast as shown in FIG. 18 mainly in that the connection mode of the capacitor $C_{in}$ is different from that of FIG. 18. In FIG. 19, the second terminal of the first capacitor $C_{in}$ is coupled to the second output terminal of the rectifier circuit.

In the above-mentioned preferred embodiments as shown in FIGS. 5-19, the usage of the series connected inductors Lx/Lx1/Lx2 is to decrease the inrush current caused by the dramatically variances of the cross voltages of the CP capacitors Cin/Cin1/Cin2 momentarily after the switch is turned on. Besides, the series connected inductor Lx/Lx1/Lx2 also possesses the functions of storing the energy therein and then transferring the energy to the load side. In FIG. 13, the additionally added set of series connected LC resonant tank ($C_r$/$L_x$) is used to provide a high frequency voltage source as a reference to the CP capacitor $C_{in}$. Each of the diodes in the Dr series (comprising Dr1-Dr2 or Dr1-Dr4) is a clamping diode, and is mainly used when the switch is cut off, the current on the inductor tends to maintain an afterflow, a path for energy release is provided via these clamping diodes, the mutually resonant time with the CP capacitors Cin/Cin1/Cin2 can be decreased, and thus it has the function of reducing the voltage stress of the switch.

Embodiments

1. An electronic ballast, comprising:

a filter circuit having a first and a second output terminals and receiving an AC input voltage;

a rectifier circuit having a first input terminal, a second input terminal coupled to the second output terminal of the filter circuit, and a first output terminal;

a continuous-conduction-mode charge pump PFC circuit, comprising:

a first inductor having a first terminal coupled to the first input terminal of the rectifier circuit, and a second terminal coupled to the first output terminal of the filter circuit;

a first diode having an anode and a cathode coupled to the first output terminal of the rectifier circuit;

a second inductor having a first terminal;

a first capacitor having a first terminal coupled to the first terminal of the first inductor and a second terminal coupled to the anode of the first diode and the first terminal of the second inductor; and a second diode having a cathode coupled to the first terminal of the second inductor; and a full-bridge inverter coupled to the continuous-conduction-mode charge pump PFC circuit and generating an AC output voltage.

2. An electronic ballast according to embodiment 1 further comprising a second capacitor, wherein the rectifier circuit further comprises a second output terminal, the full-bridge inverter has a first and a second input terminals, a middle point, a first and a second output terminals and a bridge arm, the bridge arm includes a first switch and a second switch, the first switch of the bridge arm is coupled to the first input terminal of the full-bridge inverter and the middle point and has a first bypass diode, the second switch of the bridge arm is coupled to the middle point and the second input terminal of the full-bridge inverter and has a second bypass diode, the continuous-conduction-mode charge pump PFC circuit further includes a third diode having an anode coupled to the first terminal of the first capacitor and a cathode coupled to the cathode of the first diode, the second inductor has a second terminal coupled to the middle point of the full-bridge inverter, the cathode of the first diode is coupled to the first input terminal of the full-bridge inverter, the second input terminal of the full-bridge inverter is coupled to the second output terminal of the rectifier circuit, the rectifier circuit comprises the third diode, the first bypass diode of the first switch, the second bypass diode of the second switch and a fourth diode, the second diode further comprises an anode coupled to the second input terminal of the full-bridge inverter, and the second capacitor is electrically connected to the first and the second output terminals of the full-bridge inverter in parallel.

3. An electronic ballast according to embodiment 1 or 2, wherein the second capacitor is an output capacitor, and the continuous-conduction-mode charge pump PFC circuit is a continuous-conduction-mode voltage-source charge pump PFC circuit.

4. An electronic ballast according to any one of embodiments 1 to 3, wherein the continuous-conduction-mode charge pump PFC circuit further comprises a third capacitor having a first terminal coupled to the first terminal of the second inductor, and a second terminal coupled to the anode of the second diode.

5. An electronic ballast, comprising:

a rectifier circuit having a first input terminal and a second input terminal;

a continuous-conduction-mode charge pump PFC circuit, comprising:

a first inductor having a first terminal coupled to the first input terminal of the rectifier circuit, and a second terminal;

a second inductor having a first terminal; and a first capacitor having a first terminal coupled to the first terminal of the first inductor and a second terminal coupled to the first terminal of the second inductor; and a full-bridge inverter coupled to the continuous-conduction-mode charge pump PFC circuit and generating an AC output voltage.

6. An electronic ballast according to embodiment 5 further comprising a filter circuit having a first and a second output terminals and receiving an AC input voltage, wherein the second input terminal of the rectifier circuit is coupled to the second output terminal of the filter circuit and the second terminal of the first inductor is coupled to the first output terminal of the filter circuit.

7. An electronic ballast according to embodiment 5 or 6 further comprising a first and a second diodes, each of which comprises an anode and a cathode, wherein the rectifier circuit further comprises a first and a second output terminals, the cathode of the first diode is coupled to the first output terminal of the rectifier circuit, the anode of the first diode is coupled to the second terminal of the first capacitor, the cathode of the second diode is coupled to the first terminal of the second inductor, and the anode of the second diode is coupled to the second output terminal of the rectifier circuit.

8. An electronic ballast according to any one of embodiments 5 to 7, wherein the full-bridge inverter has a first and a second input terminals and a middle point, the second inductor has a second terminal coupled to the middle point, the cathode of the first diode is coupled to the first input terminal of the full-bridge inverter, and the second input terminal of the full-bridge inverter is coupled to the second output terminal of the rectifier circuit.

9. An electronic ballast, comprising:

a continuous-conduction-mode charge pump PFC circuit; and a full-bridge inverter coupled to the continuous-conduction-mode charge pump PFC circuit and generating an AC output voltage.

10. An electronic ballast according to embodiment 9, wherein the continuous-conduction-mode charge pump PFC circuit further comprises a first inductor and a second inductor.

11. An electronic ballast according to embodiment 9 or 10 further comprising a rectifier circuit having a first input terminal and a second input terminal, wherein the continuous-conduction-mode charge pump PFC circuit further comprises a first capacitor and a second capacitor, the first inductor has a first terminal coupled to the first input terminal of the rectifier circuit and has a second terminal coupled to the first output terminal of the filter circuit, the first capacitor has a first terminal, the second capacitor has a first terminal coupled to the first terminal of the first capacitor and has a second terminal, and the second inductor has a first terminal coupled to the second terminal of the second capacitor.

12. An electronic ballast according to any one of embodiments 9-11 further comprising a filter circuit having a first and a second output terminals and receiving an AC input voltage, wherein the second input terminal of the rectifier circuit is coupled to the second output terminal of the filter circuit and the second terminal of the first inductor is coupled to the first output terminal of the filter circuit.

13. An electronic ballast according to any one of embodiments 9-12, wherein the rectifier circuit further has a first output terminal, the first capacitor further has a second terminal coupled to the first output terminal of the rectifier circuit, and the continuous-conduction-mode charge pump PFC circuit is a continuous-conduction-mode current-source charge pump PFC circuit.

14. An electronic ballast according to any one of embodiments 9-13, wherein the rectifier circuit further has a first and a second output terminals, and the first capacitor further has a second terminal coupled to the second output terminal of the rectifier circuit.

According to the aforementioned descriptions, the present invention provides a full-bridge electronic ballast having a simplified continuous-conduction-mode charge pump PFC circuit with the following advantages due to that the CP PFC technique is utilized: decreasing the required number of elements in the circuit so as to reduce the circuit costs, having low input current harmonic distortion and high power factor, decreasing the volumes of the elements such as PFC inductor and EMI filter, and decreasing the switching losses of a switch and the conduction losses of a diode so as to possess the non-obviousness and the novelty.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present invention which is defined by the appended claims.

What is claimed is:

1. An electronic ballast, comprising:

a filter circuit including a filter circuit inductor and a filter circuit capacitor and having a first and a second output terminals and receiving an AC input voltage;

a rectifier circuit having a first input terminal, a second input terminal and a first output terminal, wherein the second input terminal is coupled to the second output terminal of the filter circuit;

a continuous-conduction-mode charge pump PFC circuit, comprising:

a first PFC circuit inductor having a first terminal coupled to the first input terminal of the rectifier circuit, and a second terminal coupled to the first output terminal of the filter circuit;

a first PFC circuit diode having an anode and a cathode, wherein the cathode is coupled to the first output terminal of the rectifier circuit;

a second PFC circuit inductor having a first terminal;

a first PFC circuit capacitor having a first terminal and a second terminal, wherein the first terminal of the first PFC circuit capacitor is directly electrically connected to the first terminal of the first PFC circuit inductor, and the second terminal of the first PFC circuit capacitor is directly electrically connected to the anode of the first PFC circuit diode and the first terminal of the second PFC circuit inductor; and a second PFC circuit diode having a cathode directly electrically connected to the first terminal of the second PFC circuit inductor; and a full-bridge inverter coupled to the continuous-conduction mode charge pump PFC circuit and generating an AC output voltage.

2. An electronic ballast according to claim 1 further comprising a second PFC circuit capacitor, wherein the rectifier circuit further comprises a second output terminal, the full-bridge inverter has a first and a second input terminals, a middle point, a first and a second output terminals and a bridge arm, the bridge arm includes a first switch and a second switch, the first switch of the bridge arm is coupled to the first input terminal of the full-bridge inverter and the middle point, the first switch of the bridge arm has a first bypass diode, the second switch of the bridge arm is coupled to the middle point and the second input terminal of the full-bridge inverter, the second switch of the bridge arm has a second bypass diode, the continuous-conduction-mode charge pump PFC circuit further includes a third PFC circuit diode having an anode and a cathode, the anode of the third PFC circuit diode is coupled to the first terminal of the first PFC circuit capacitor, the cathode of the third PFC circuit diode is coupled to the cathode of the first PFC circuit diode, the second PFC circuit inductor has a second terminal coupled to the middle point of the full-bridge inverter, the cathode of the first PFC circuit diode is coupled to the first input terminal of the full-bridge inverter, the second input terminal of the full-bridge inverter is coupled to the second output terminal of the rectifier circuit, the rectifier circuit comprises the third PFC circuit diode, the first bypass diode of the first switch, the second bypass diode of the second switch and a fourth PFC circuit diode, the second PFC circuit diode further comprises an anode coupled to the second input terminal of the full-bridge inverter, and the second PFC circuit capacitor is electrically connected to the first and the second output terminals of the full-bridge inverter in parallel.

3. An electronic ballast according to claim 2, wherein the second PFC circuit capacitor is an output capacitor, and the continuous-conduction-mode charge pump PFC circuit is a continuous-conduction-mode voltage-source charge pump PFC circuit.

4. An electronic ballast according to claim 2, wherein the continuous-conduction-mode charge pump PFC circuit further comprises a third PFC circuit capacitor having a first terminal coupled to the first terminal of the second PFC circuit inductor, and a second terminal coupled to the anode of the second PFC circuit diode.

5. An electronic ballast, comprising:

a rectifier circuit having a first input terminal and a second input terminal;

a continuous-conduction-mode charge pump PFC circuit, comprising:

a first PFC circuit inductor having a first terminal and a second terminal, wherein the first terminal of the first inductor is coupled to the first input terminal of the rectifier circuit;

a second PFC circuit inductor having a first terminal; and a first PFC circuit capacitor having a first terminal and a second terminal, wherein the first terminal of the first PFC circuit capacitor is directly electrically connected to the first terminal of the first PFC circuit inductor, and the second terminal of the first PFC circuit capacitor is directly electrically connected to the first terminal of the second PFCF circuit inductor;

a full-bridge inverter coupled to the continuous-conduction-mode charge pump PFC circuit and generating an AC output voltage; and a filter circuit including a filter circuit inductor and a filter circuit capacitor and having a first and a second output terminals and receiving an AC input voltage, wherein the second input terminal of the rectifier circuit is coupled to the second output terminal of the filter circuit, and the second terminal of the first PFC circuit inductor is coupled to the first output terminal of the filter circuit.

6. An electronic ballast according to claim 5 further comprising a first and a second PFC circuit diodes, each of which comprises an anode and a cathode, wherein the rectifier circuit further comprises a first and a second output terminals, the cathode of the first PFC circuit diode is coupled to the first output terminal of the rectifier circuit, the anode of the first PFC circuit diode is coupled to the second terminal of the first PFC circuit capacitor, the cathode of the second PFC circuit diode is coupled to the first terminal of the second PFC circuit inductor, and the anode of the second PFC circuit diode is coupled to the second output terminal of the rectifier circuit.

7. An electronic ballast according to claim 6, wherein the full-bridge inverter has a first and a second input terminals and a middle point, the second PFC circuit inductor has a second terminal coupled to the middle point, the cathode of the first PFC circuit diode is coupled to the first input terminal of the full-bridge inverter, and the second input terminal of the full-bridge inverter is coupled to the second output terminal of the rectifier circuit.

8. An electronic ballast, comprising:

a continuous-conduction-mode charge pump PFC circuit, comprising:

a first PFC circuit inductor having a first terminal;

a second PFC circuit inductor having a first terminal; and a first PFC circuit capacitor having a first terminal and a second terminal, wherein the first terminal of the first PFC circuit capacitor is directly electrically connected to the first terminal of the first PFC circuit inductor, and the second terminal of the first PFC circuit capacitor is directly electrically connected to the first terminal of the second PFC circuit inductor;

a full-bridge inverter coupled to the continuous-conduction-mode charge pump PFC circuit and generating an AC output voltage;

a rectifier circuit having a first input terminal and a second input terminal, wherein the continuous-conduction-mode charge pump PFC circuit further comprises a second PFC circuit capacitor, the first terminal of the first PFC circuit inductor is coupled to the first input terminal of the rectifier circuit, the second PFC circuit capacitor has a first terminal coupled to the first terminal of the first PFC circuit capacitor and has a second terminal, and the first terminal of the second PFC circuit inductor is coupled to the second terminal of the second PFC circuit capacitor; and a filter circuit including a filter circuit inductor and a filter circuit capacitor and having a first and a second output terminals and receiving an AC input voltage, wherein the second input terminal of the rectifier circuit is coupled to the second output terminal of the filter circuit, and the first PFC circuit inductor further has a second terminal coupled to the first output terminal of the filter circuit.

9. An electronic ballast according to claim 8, wherein the rectifier circuit further has a first output terminal, the second terminal of the first PFC circuit capacitor is coupled to the first output terminal of the rectifier circuit, and the continuous-conduction-mode charge pump PFC circuit is a continuous-conduction-mode current-source charge pump PFC circuit.

10. An electronic ballast according to claim 8, wherein the rectifier circuit further has a first and a second output terminals, and the second terminal of the first PFC circuit capacitor is coupled to the second output terminal of the rectifier circuit.

* * * * *